US005558608A

United States Patent [19]

Hall

[11] Patent Number: 5,558,608

[45] Date of Patent: Sep. 24, 1996

[54] MOTOR VEHICLE MOUNTABLE EXERCISE DEVICE

[76] Inventor: Barry L. Hall, P.O. Box 1986, Valdosta, Ga. 31603-1986

[21] Appl. No.: 536,486

[22] Filed: Sep. 29, 1995

[51] Int. Cl.[6] ..... A63B 21/02

[52] U.S. Cl. ..... 482/129; 482/904

[58] Field of Search ..... 482/129, 904, 482/130, 121, 122, 123

[56] References Cited

U.S. PATENT DOCUMENTS 5,135,216 8/1992 Bingham et al. ..... 482/130

*Primary Examiner*—Lynne A. Reichard

[57] ABSTRACT

A motor vehicle mountable exercise device comprising, in combination: a central beam with an upper end, a lower end, a front face, a rear face and two side faces, the side faces each including a plurality of aligned circular apertures, a cylindrical rod being positioned horizontally through aligned apertures adjacent to the upper end; a handle comprising a gripping member and a pair of spaced arms, each arm having a free end including an aperture, two cross members coupling the arms to each other, each arm including an outwardly extending cylindrical extension bar, a cylindrical pin rotatably coupling the free ends of the handle to the central beam, two elastomeric bands each being coupled around a cylindrical rod and an extension bar of the handle, in an operative orientation a user grasping the gripping member of the bar and pushing downward or pulling upward, the elastomeric bands providing the necessary resistance to aid in muscle development, in an operative orientation the central beam being coupled to a motor vehicle to permit the performance of various exercises with the apparatus.

3 Claims, 3 Drawing Sheets

MOTOR VEHICLE MOUNTABLE EXERCISE DEVICE

BACKGROUND OF THE INVENTION

1. Field of the Invention

The present invention relates to a motor vehicle mountable exercise device and more particularly pertains to coupling the apparatus to a motor vehicle to permit exercising of one's upper body during road trips.

2. Description of the Prior Art

The use of exercise devices is known in the prior art. More specifically, exercise devices heretofore devised and utilized for the purpose of utilizing the devices to develop various muscles of the body are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,277,683 to Wilkins a total gym.

U.S. Pat. No. 5,324,243 to Wilkinson discloses a universal portable exercise apparatus adaptable to fit a chair.

U.S. Pat. No. 5,230,683 to Van Der Hoeven discloses a multi-functional exercising apparatus.

U.S. Pat. No. 5,152,732 to Sayre discloses a portable gym.

Lastly, U.S. Pat. No. 5,298,004 to Davis discloses an exercise apparatus.

In this respect, the motor vehicle mountable exercise device according to the present invention substantially departs from the conventional concepts and designs of the prior art, and in doing so provides an apparatus primarily developed for the purpose of coupling the apparatus to a motor vehicle to permit exercising of one's upper body during road trips.

Therefore, it can be appreciated that there exists a continuing need for a new and improved motor vehicle mountable exercise device which can be used for coupling the apparatus to a motor vehicle to permit exercising of one's upper body during road trips. In this regard,, the present invention substantially fulfills this need.

SUMMARY OF THE INVENTION

In view of the foregoing disadvantages inherent in the known types of exercise devices now present in the prior art, the present invention provides an improved motor vehicle mountable exercise device. As such, the general purpose of the present invention, which will be described subsequently in greater detail, is to provide a new and improved motor vehicle mountable exercise device and method which has all the advantages of the prior art and none of the disadvantages.

To attain this, the present invention essentially comprises a new and improved motor vehicle mountable exercise device comprising, in combination: a central beam fabricated of steel and formed in a hollow generally rectangular configuration with an upper end and a lower end, the central beam having a front face, a rear face and two side faces, the side faces each including first, second and third pairs of aligned circular apertures, the apertures being positioned below the upper end of the central beam one above the other, a cylindrical rod being positioned horizontally through the first and third pairs of apertures, each rod extending equidistantly from each side face; a handle comprising a generally cylindrical shaped gripping member and a pair of spaced arms affixed centrally thereto, each arm having a free end including a circular aperture extending therethrough, two cross members coupling the arms to each other, each arm including an outwardly extending cylindrical extension bar, a cylindrical pin adapted to couple the free ends of the arms of the handle to the central beam, the pin being positioned through the apertures in the arm and second pair of apertures thereby rotatably coupling the handle to the central beam, two elastomeric bands formed in a generally circular configuration, each band being coupled around an end of a cylindrical rod and an extension bar of an arm, in an operative orientation a user grasping the gripping member of the bar and pushing downward or pulling upward, the elastomeric bands providing the necessary resistance to aid in muscle development, the approximate centerpoint of the central beam including an aligned pair of central apertures extending through the sidewalls, the lower end of the central beam including a plurality of aligned lower apertures extending therethrough; and a ground base formed in a planar generally rectangular configuration with a pair of spaced upstanding brackets extending therefrom, each bracket including a plurality of apertures extending therethrough, at least two bolts being positioned through the apertures in the beam and brackets to couple the ground base to the lower end of the beam; two legs formed in a hollow generally rectangular configuration and including an upper extent, a lower leg being telescopically positioned within each upper leg, each lower leg being vertically adjustable within an upper leg, the upper and lower legs to be coupled within the trunk of a motor vehicle, a cross support formed in a planar generally rectangular configuration being coupled across the upper extent of the upper legs, a horizontal beam having a first end and a second end, the second end being coupled to the approximate centerpoint of the cross support, the first end of the horizontal beam including a pair of elongated apertures, the first end adapted to be coupled to the approximate centerpoint of the central beam by a nut and bolt through the aligned elongated apertures in the horizontal beam and central apertures in the central beam, the elongated apertures permitting rearward or frontward adjustment of the central beam with respect to the horizontal beam.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motor vehicle mountable exercise device which has all of the advantages of the prior art exercise devices and none of the disadvantages.

It is another object of the present invention to provide a new and improved motor vehicle mountable exercise device which may be easily and efficiently manufactured and marketed.

It is further object of the present invention to provide a new and improved motor vehicle mountable exercise device which is of durable and reliable constructions.

An even further object of the present invention is to provide a new and improved motor vehicle mountable exercise device which is susceptible of a low cost of manufacture with regard to both materials and labor, and which accordingly is then susceptible of low prices of sale to the consuming public, thereby making such motor vehicle mountable exercise device economically available to the buying public.

Still yet another object of the present invention is to provide a new and improved motor vehicle mountable exercise device which provides in the apparatuses and methods of the prior art some of the advantages thereof, while simultaneously overcoming some of the disadvantages normally associated therewith.

Still another object of the present invention is to coupling the apparatus to a motor vehicle to permit exercising of one's upper body during road trips.

Lastly, it is an object of the present invention to provide a new and improved a motor vehicle mountable exercise device comprising, in combination: a central beam with an upper end, a lower end, a front face, a rear face and two side faces, the side faces each including a plurality of aligned circular apertures, a cylindrical rod being positioned horizontally through aligned apertures adjacent to the upper end; a handle comprising a gripping member and a pair of spaced arms, each arm having a free end including an aperture, two cross members coupling the arms to each other, each arm including an outwardly extending cylindrical extension bar, a cylindrical pin rotatably coupling the free ends of the handle to the central beam, two elastomeric bands each being coupled around a cylindrical rod and an extension bar of the handle, in an operative orientation a user grasping the gripping member of the bar and pushing downward or pulling upward, the elastomeric bands providing the necessary resistance to aid in muscle development, in an operative orientation the central beam being coupled to a motor vehicle to permit the performance of various exercises with the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
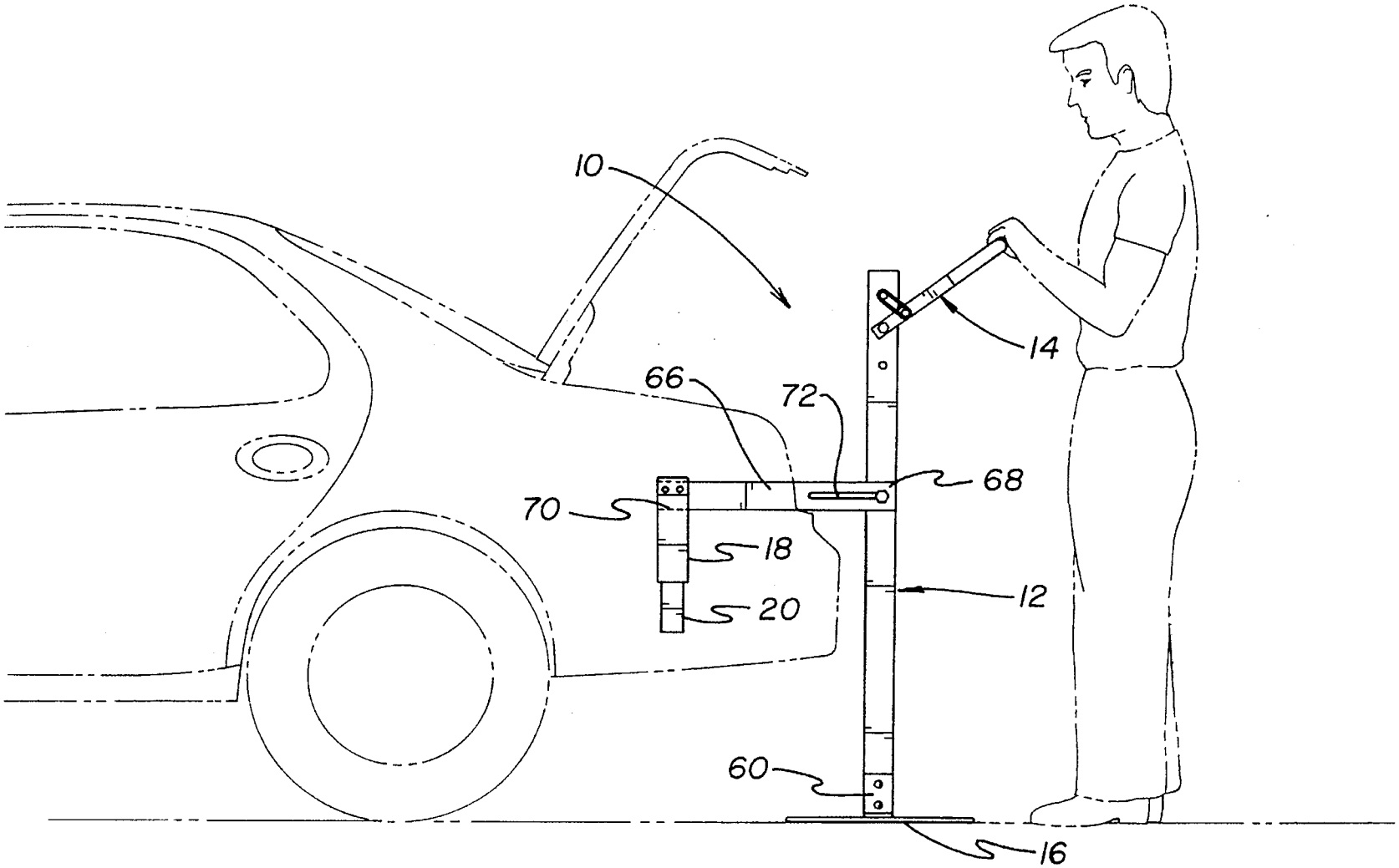
FIG. 1 is a perspective view of the preferred embodiment of the motor vehicle mountable exercise device constructed in accordance with the principles of the present invention.

With reference now to the drawings, and in particular to FIG. 1 thereof, the preferred embodiment of the new and improved motor vehicle mountable exercise device embodying the principles and concepts of the present invention and generally designated by the reference numeral 10 will be described.

The present invention, the motor vehicle mountable exercise device 10 is comprised of a plurality of components. Such components in their broadest context include a central beam 12, a handle 14, a ground base 16, two upper legs 18 and two lower legs 20. Such components are individually configured and correlated with respect to each other so as to attain the desired objective.

Figure 2:
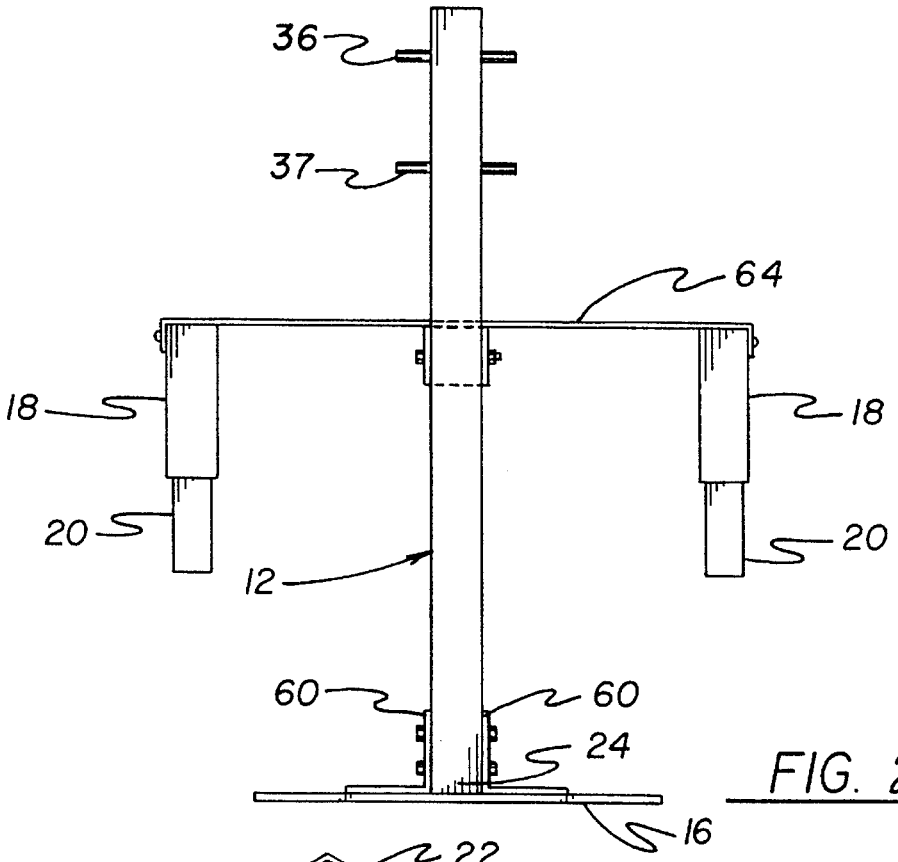
FIG. 2 is a front perspective view of the apparatus shown in FIG. 1.

A central beam 12 is fabricated of steel and is formed in a hollow generally rectangular configuration with an upper end 22 and a lower end 24. The majority of the components of the apparatus are fabricated of steel to ensure its utility and longevity. The central beam has a front face 26, a rear face and two side faces 28. The central beam is formed of 11 gauge tubing and is fifty five inches in height. The central beam is positioned vertically in an operative orientation. The side faces each include first 30, second 32 and third 34 pairs of horizontally aligned circular apertures. The apertures are positioned below the upper end of the central beam one above the other. A cylindrical rod 36, 37 is positioned horizontally through the first and third pairs of apertures. Each rod extends equidistantly from each side face. The rod and apertures are each about three-eighths of an inch in diameter. Note FIGS. 1 and 2.

Figure 3:
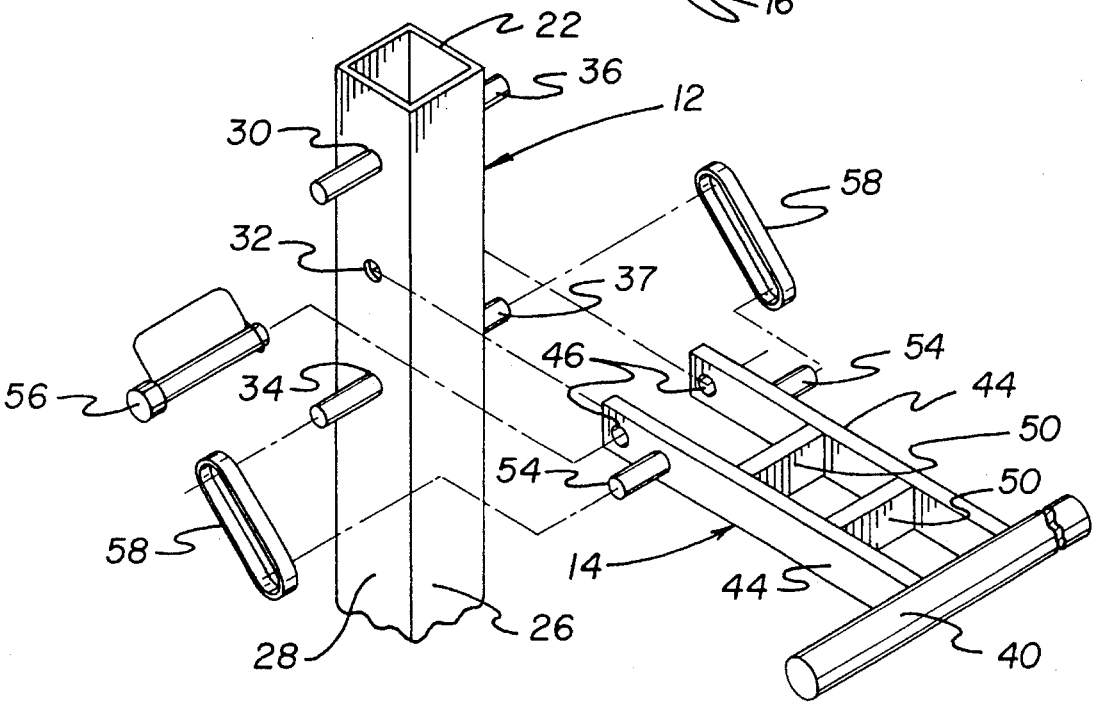
FIG. 3 is an exploded top view of the central beam, handle and other various components of the apparatus.

A handle 14 is comprised of a generally cylindrical shaped gripping member and a pair of spaced arms 44 are affixed centrally to it. Each arm has a free end which includes a circular aperture 46 extending through it. Two cross members 50 couple the arms to each other. Each arm includes an outwardly extending cylindrical extension bar 54. A cylindrical pin 56 is adapted to couple the free ends of the arms of the handle to the central beam. The pin is positioned through the apertures in the arm and second pair of apertures in the beam to rotatably couple the handle to the central beam. Note FIG. 3.

Figure 4:
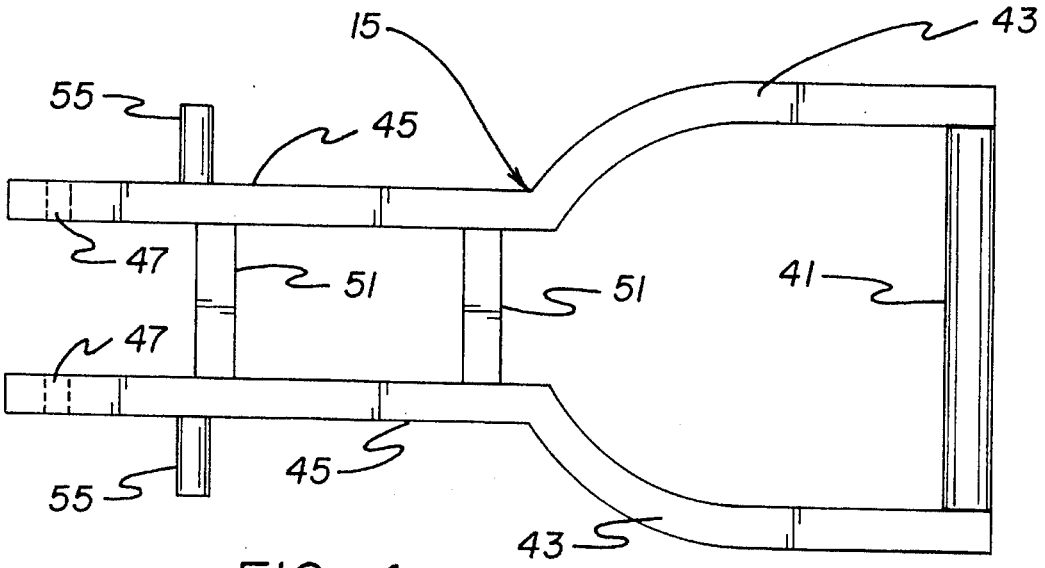
FIG. 4 illustrates an alternative embodiment of the handle of the apparatus.

An alternative embodiment of the handle 15 is shown in FIG. 4. In such embodiment the handle 15 includes a spaced pair of arms 45, two cross members 51, two free ends including apertures 47 and two cylindrical extension bars 55. The handle 15 further includes two rounded side members 43 each formed contiguously with the spaced arms. A gripping member 41 is rotatably coupled between the free ends of the side members 43. The gripping member of the handle 15 is rotatable to prevent frictional rubbing of the user's hands against the gripping member when pulling or pushing the handle. Note FIGS. 3 and 4.

Two elastomeric bands 58 are formed in a generally circular configuration. Each band is coupled around an end of a cylindrical rod and an extension bar of an arm. If a user wishes to exercise by pulling the handle upwardly, the elastomeric bands are positioned around the lower cylindrical rod 37. If a user wishes to exercise by pushing the handle in a downward direction the elastomeric bands are positioned around the upper cylindrical rods and the user pushes downwardly on handle. When positioned around a rod and extension bar the bands are in a tight orientation. The tight orientation serves to prevents unwanted slippage of the bands during use. The elastomeric bands provide the necessary resistance to aid in muscle development. Note FIGS. 1 and 3.

The approximate centerpoint of the central beam includes an aligned pair of central apertures extending through the sidewalls. The lower end of the central beam includes a plurality of aligned lower apertures extending through it. The central and lower apertures permit coupling of the ground base and horizontal beam of the apparatus. Note FIGS. 1 and 2.

A ground base 16 is formed in a planar generally rectangular configuration with a pair of spaced upstanding brackets 60 extending from it. The ground base is fabricated of steel and is three inches deep, sixteen inches wide and one-quarter inch thick. This configuration provides the apparatus with a very stable and secure base. A stable base is very important when exercising to prevent unwanted movement during use of the apparatus. Each bracket includes a plurality of apertures extending through it. At least two bolts are positioned through the apertures in the beam and brackets to couple the ground base to the lower end of the beam. Note FIGS. 1 and 2.

Figure 5:
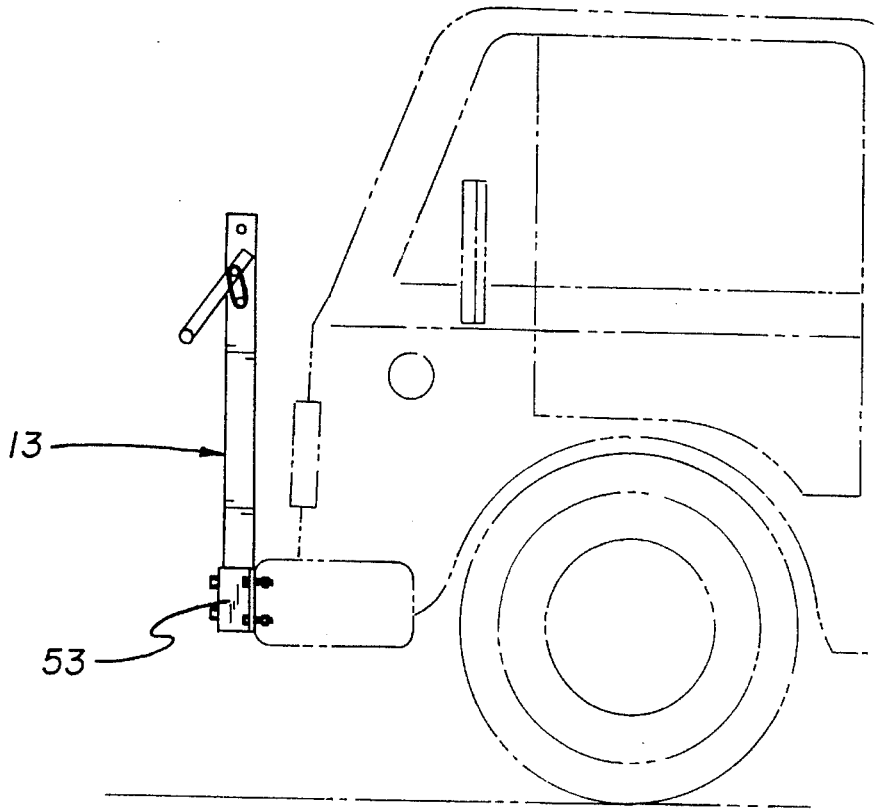
FIG. 5 illustrates an alternate embodiment of the apparatus coupled to the front bumper of a motor vehicle.

An alternative embodiment of the apparatus 13 is shown in FIG. 5. In such embodiment a ground base is not included with the apparatus. In contrast, the lower extent of the beam includes apertures extending through its front and rear faces. In addition, the apparatus includes a generally rectangular shaped bracket 53 adapted to be coupled to the bumper of a motor vehicle. The bracket includes a front face and side members, each having a plurality of apertures. A plurality of bolts couple the side members to the beam of the vehicle. In an operative orientation the lower extent of the beam is positioned within the bracket 53 with a plurality of bolts securely coupling the lower extent of the beam within the bracket. This configuration allows a user to exercise without requiring the legs and cross bars recited in the preferred embodiment of the apparatus. Note FIGS. 2 and 5.

Two upper legs 18 are each formed in a hollow generally rectangular configuration with an upper extent. A lower leg 20 is telescopically positioned within each upper leg. Each lower leg is vertically adjustable within an upper leg. The upper and lower legs are adapted to be coupled within the trunk of a motor vehicle. The adjustability feature permits coupling of the legs within a plurality of differently sized automobile trunks. Together, the upper and lower legs enable a user to adjust the vertical height of the legs in a range between 24 and 40 inches. Note FIGS. 1 and 2.

A cross support 64 is formed in a planar generally rectangular configuration coupled across the upper extent of the upper legs. A horizontal beam 66 has a first end 68 and a second end 70. The horizontal beam is approximately 18 inches in length and positioned perpendicular to the legs and central beam of the apparatus during use. The second end is coupled to the approximate centerpoint of the cross support. The first end of the horizontal beam includes a pair of elongated apertures 72. The apertures are approximately six inches in length. The first end is coupled to the approximate centerpoint of the central beam by a nut and bolt through the aligned elongated apertures in the horizontal beam and central apertures in the central beam. The elongated apertures permit rearward or frontward adjustment of the central beam with respect to the horizontal beam. The adjustable elongated apertures permit users to adjust the length of the horizontal beam to accommodate differently sized trunks and bumpers of motor vehicles. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved motor vehicle mountable exercise device comprising, in combination:

a central beam fabricated of steel and formed in a hollow generally rectangular configuration with an upper end and a lower end, the central beam having a front face, a rear face and two side faces, the side faces each including first, second and third pairs of aligned circular apertures, the apertures being positioned below the upper end of the central beam one above the other, a cylindrical rod being positioned horizontally through the first and third pairs of apertures, each rod extending equidistantly from each side face;

a handle comprising a generally cylindrical shaped gripping member and a pair of spaced arms affixed centrally thereto, each arm having a free end including a circular aperture extending therethrough, two cross members coupling the arms to each other, each arm including an outwardly extending cylindrical extension bar, a cylindrical pin adapted to couple the free ends of the arms of the handle to the central beam, the pin being positioned through the apertures in the arm and second pair of apertures thereby rotatably coupling the handle to the central beam, two elastomeric bands formed in a generally circular configuration, each band being coupled around an end of a cylindrical rod and an extension bar of an arm, in an operative orientation a user grasping the gripping member of the bar and pushing downward or pulling upward, the elastomeric bands providing the necessary resistance to aid in muscle development, the approximate centerpoint of the central beam including an aligned pair of central apertures extending through the sidewalls, the lower end of the central beam including a plurality of aligned lower apertures extending therethrough;

a ground base formed in a planar generally rectangular configuration with a pair of spaced upstanding brackets extending therefrom, each bracket including a plurality of apertures extending therethrough, at least two bolts being positioned through the apertures in the beam and brackets to couple the ground base to the lower end of the beam; and two legs formed in a hollow generally rectangular configuration and including an upper extent, a lower leg being telescopically positioned within each upper leg, each lower leg being vertically adjustable within an upper leg, the upper and lower legs to be coupled within the trunk of a motor vehicle, a cross support formed in a planar generally rectangular configuration being coupled across the upper extent of the upper legs, a horizontal beam having a first end and a second end, the second end being coupled to the approximate centerpoint of the cross support, the first end of the horizontal beam including a pair of elongated apertures, the first end adapted to be coupled to the approximate centerpoint of the central beam by a nut and bolt through the aligned elongated apertures in the horizontal beam and central apertures in the central beam, the elongated apertures permitting rearward or frontward adjustment of the central beam with respect to the horizontal beam.

2. A motor vehicle mountable exercise device comprising, in combination:

a central beam with an upper end and a lower end, the central beam having a front face, a rear face and two side faces, the side faces each including a plurality of aligned circular apertures, a cylindrical rod being positioned horizontally through aligned apertures adjacent to the upper end, the lower end and approximate center point of the central beam each including a plurality of apertures;

a handle comprising a gripping member and a pair of spaced arms affixed to the gripping member, each arm having a free end including an aperture, two cross members coupling the arms to each other, each arm including an outwardly extending cylindrical extension bar, a cylindrical pin rotatably coupling the free ends of the handle to the central beam, two elastomeric bands each being coupled around a cylindrical rod and an extension bar of the handle, in an operative orientation a user grasping the gripping member of the bar and pushing downward or pulling upward, the elastomeric bands providing the necessary resistance to aid in muscle development, the central beam being couplable to a motor vehicle;

a ground base formed in a planar generally rectangular configuration with a pair of spaced upstanding brackets extending therefrom, each bracket including a plurality of apertures extending therethrough, at least two bolts being positioned through the apertures in the beam and brackets to couple the ground base to the lower end of the beam; and two legs formed in a hollow generally rectangular configuration and including an upper extent, a lower leg being telescopically positioned within each upper leg, each lower leg being vertically adjustable within an upper leg, the upper and lower legs to be coupled within the trunk of a motor vehicle, a cross support formed in a planar generally rectangular configuration being coupled across the upper extent of the upper legs, a horizontal beam having a first end and a second end, the second end being coupled to the approximate centerpoint of the cross support, the first end of the horizontal beam including a pair of elongated apertures, the first end adapted to be coupled to the approximate centerpoint of the central beam by a nut and bolt through the aligned elongated apertures in the horizontal beam and central apertures in the central beam, the elongated apertures permitting rearward or frontward adjustment of the central beam with respect to the horizontal beam.

3. A motor vehicle mountable exercise device comprising, in combination:

a central beam with an upper end and a lower end, the central beam having a front face, a rear face and two side faces, the side faces each including a plurality of aligned circular apertures, a cylindrical rod being positioned horizontally through aligned apertures adjacent to the upper end, the lower end of the central beam including a plurality of apertures extending through its front and rear faces;

a handle comprising a gripping member and a pair of spaced arms affixed to the gripping member, each arm having a free end including an aperture, two cross members coupling the arms to each other, each arm including an outwardly extending cylindrical extension bar, a cylindrical pin rotatably coupling the free ends of the handle to the central beam, two elastomeric bands each being coupled around a cylindrical rod and an extension bar of the handle, in an operative orientation a user grasping the gripping member of the bar and pushing downward or pulling upward, the elastomeric bands providing the necessary resistance to aid in muscle development, the central beam being couplable to a motor vehicle; and a bracket formed in a generally rectangular configuration with two side members and a front face, the side members and front face each including a plurality of apertures, the side members adapted to be coupled to a bumper of a motor vehicle by a plurality of bolts, the lower end of the central beam adapted to be positioned within the bracket with the apertures in the front face of the bracket in alignment with the apertures in the front and rear faces of the lower end of the beam, a plurality of bolts being positioned through the aligned apertures securely coupling the beam within the bracket.

* * * * *